US007648750B2

(12) United States Patent
Sattora et al.

(10) Patent No.: US 7,648,750 B2
(45) **Date of Patent: *Jan. 19, 2010**

(54) FLEXIBLE MOLDED END CAP CUSHION

(75) Inventors: Christopher J. Sattora, Cary, NC (US); Eric A. Stegner, Durham, NC (US); Robert W. Stegner, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 522 days.

This patent is subject to a terminal disclaimer.

(21) Appl. No.: 11/297,666

(22) Filed: Dec. 7, 2005

(65) Prior Publication Data

US 2007/0148400 A1 Jun. 28, 2007

(51) Int. Cl.
*B65D 81/07* (2006.01)
*B65D 81/113* (2006.01)

(52) U.S. Cl. ..... 428/99; 206/586; 206/587; 206/588; 206/591

(58) Field of Classification Search ..... 428/99; 206/591, 586, 587, 592, 523, 588
See application file for complete search history.

(56) References Cited

U.S. PATENT DOCUMENTS

| | | | | |
|---|---|---|---|---|
| 638,785 | A | 12/1899 | Whittlesey | |
| D160,272 | S | 9/1950 | Reynolds | |
| 2,841,277 | A | 7/1958 | Paige | |
| 3,035,825 | A | 5/1962 | Weller | |
| 3,061,089 | A | 10/1962 | Higgins | |
| 3,708,084 | A | 1/1973 | Bixler et al. | |
| 3,738,725 | A | 6/1973 | Visser | |
| 4,015,709 | A | 4/1977 | Millet | |
| 4,368,840 | A | 1/1983 | Pardo | |
| 4,867,307 | A * | 9/1989 | Bovee | 206/315.1 |
| 5,207,327 | A * | 5/1993 | Brondos | 206/523 |
| 6,170,659 | B1 | 1/2001 | Hunter | |
| 6,274,217 | B1 | 8/2001 | Kim | |
| 2004/0055929 | A1 | 3/2004 | Smith | |
| 2005/0155890 | A1 * | 7/2005 | Manuel | 206/523 |

* cited by examiner

*Primary Examiner*—Alexander Thomas
(74) *Attorney, Agent, or Firm*—Dillon & Yudell LLP

(57) ABSTRACT

A cushion apparatus that may be advantageously utilized as an end cap for packaging shock sensitive products is disclosed herein. In one embodiment, the cushion apparatus includes a base member having one or more side walls having inner product bearing surfaces defining a product receiving cavity. The product receiving cavity has an open bottom end through which the product is received and an opposing top end. An axial deflection member is disposed over the top end of the receiving cavity. The axial deflection member is an arc-shaped elastic material member arching over the top end of the product receiving cavity. In one embodiment, the cushion apparatus further includes multiple radial deflection members extending radially from the base member to define a multi-sided bearing support perimeter having multiple corners.

9 Claims, 2 Drawing Sheets

FLEXIBLE MOLDED END CAP CUSHION

BACKGROUND OF THE INVENTION

1. Technical Field

The present invention relates generally to protective cushioning devices for use in transport and storage of shock sensitive products. In particular, the present invention relates to cushions that are made from molded polymeric materials, and which are particularly intended for use with shock sensitive products such as computer components such as optical drives.

2. Description of the Related Art

Product cushioning devices utilized for protecting shock sensitive products have been developed to address ever changing transport and storage requirements. A number of different techniques for cushioning products have been developed over the years, each having its own particular advantages and/or disadvantages. For example, it has been known for many years to cushion shock sensitive devices or merchandise using flexible, shock absorbent materials such as loosely packed paper, bubble wrap, polystyrene pellets ("peanuts"), gas-filled bladders, etc., to provide "filler" cushioning within a product container.

The market introduction of complex and expensive electronics devices together with the continual quest for greater packaging and shipment efficiency has prompted more stringent packaging and cushioning design. More precise standards and testing procedures have been developed for assuring that cushioning devices adequately protect shock sensitive products from shock accelerations greater than the product's fragility level while minimizing the form factor of packaging containers.

The need for more product-specific cushioning and reduced packaging form factor has given rise to using packaging and cushioning devices that provide combined bracing/cushioning properties. Such products include honeycomb cardboard, and various foamed polymers—polystyrene, polyurethane, polypropylene, and polyethylene. Such bracing/cushioning devices are deployed as corner pieces or edge pieces and enhance product protection by restricting shifting of the product within the container such that the cushioning effect of the overall packaging apparatus can be more reliably established. The more rigid of such cushioning materials, such as foamed polystyrene products, are often utilized as corner pieces or end caps. Such end caps are often product specific, having a particularly contoured mold conforming to the contour of a particular product.

A problem with conventional blow molded cushioning is the reliance on material properties and static structural properties, such as bearing area, to provide the required cushioning. Given the aforementioned need to balance specific cushioning requirements with shipping density requirements, substantial cost and time must be invested to design and produce specialized cushions for each new product development or modification.

Another problem is that polymer foam-type cushioning devices have limited reusability. For some such devices, such as foamed polystyrene, this is due in part, to the relative bulk and unwieldiness of such foam cushioning devices, which are usually discarded with the packaging container in which the product was shipped. Furthermore, many such foamed cushioning devices are highly frangible once they have been removed from the packaging container in which the product was shipped. Another significant factor limiting reusability is the material fatigue resulting from reliance on the material properties and static structural properties (e.g. bearing area).

The deformation and other material affects of repeated use in cushioning render the cushioning performance unpredictable.

It can be appreciated that a need exists for an improved cushioning end cap design that addresses the foregoing problems. The cushion end cap addresses the foregoing problems as well as others not addresses by the prior art.

SUMMARY OF THE INVENTION

A cushion apparatus is disclosed herein that may be advantageously utilized as an end cap for packaging shock sensitive products is disclosed herein. The cushion apparatus includes a base member having one or more side walls having inner product bearing surfaces defining a product receiving cavity. The product receiving cavity has an open bottom end through which the product is received and an opposing top end. An axial deflection member is disposed over the top end of the receiving cavity. The axial deflection member is an arc-shaped elastic material member arching over the top end of the product receiving cavity. In one embodiment, the cushion apparatus further includes multiple radial deflection members extending radially from the base member to define a multi-sided bearing support perimeter having multiple corners.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF ILLUSTRATIVE EMBODIMENT(S)

The present invention is generally directed to a cushion end cap for protecting shock sensitive products during transport and storage. Manufacturers and distributors of shock sensitive electronic components, such as magnetic and optical disk drives, often package such components individually within packaging containers. The present invention is directed to an end cap cushion apparatus that provides requisite shock absorption and attenuation properties while minimizing the amount and size of cushion materials required thereby reducing overall form factor of the packaged product. In one embodiment, the present invention is embodied as an end cap disposable at two or more ends of shock sensitive products. The dimensions of the end cap cushion, and particularly the relative disposition and dimensions of multiple radial deflection members, are such that the cushion fits securely in substantially exact conformity with the inner compartment dimensions of a packaging container. The cushion further includes a recess or cavity in which an end of a shock sensitive product may be received.

In one embodiment, the end cap cushion is designed for use in a rectilinear outer packaging container. The end cap cushion generally comprises a base member having a product receiving cavity formed therein and having side walls providing product bearing surfaces in the interior of the support cavity. The product bearing surfaces form the product receiving cavity having an open end though which the product is received. Multiple radial deflection members extend outwardly from the base member to form a substantially rectangular bearing support perimeter that substantially conforms to the inner dimensions of a packaging container. The ends of the radial deflection members extend diagonally to the corners of the rectangular bearing support perimeter. The cushion end cap further includes an arc-shaped axial deflection member disposed over an opposing end of the cavity opposing the product receiving open end.

Figure 1:
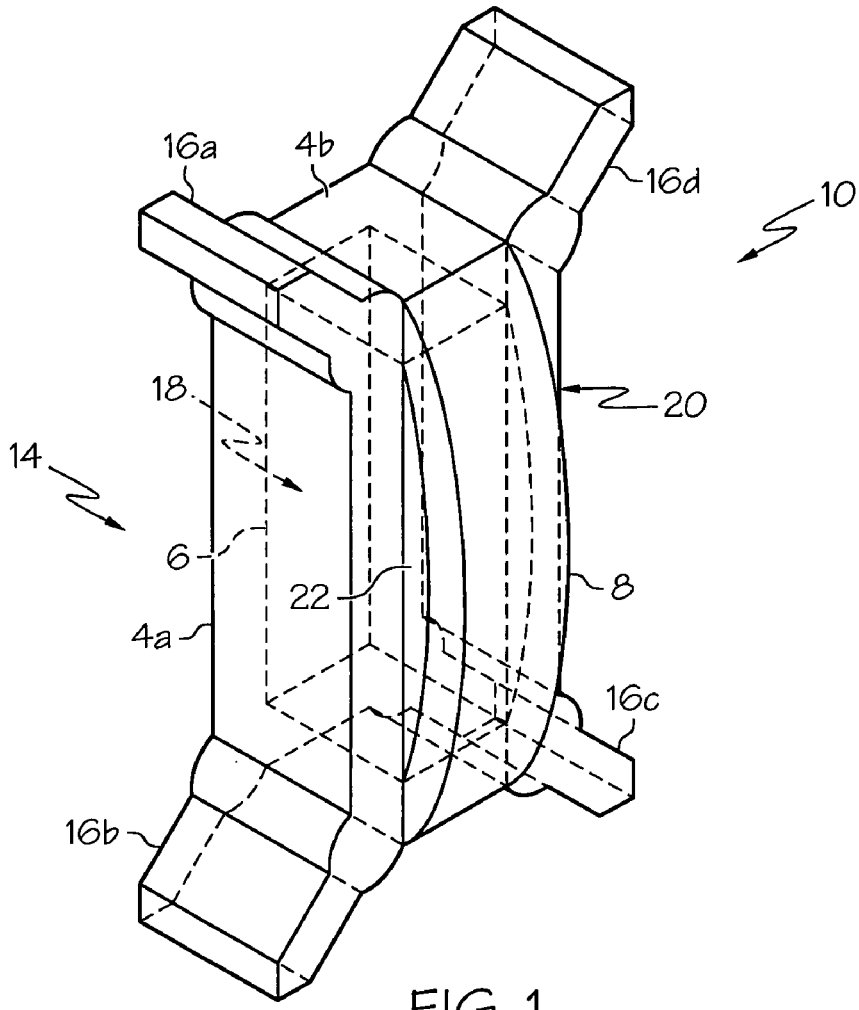
FIG. 1 illustrates an isometric view of a cushion apparatus in accordance with the present invention.
Figure 3:
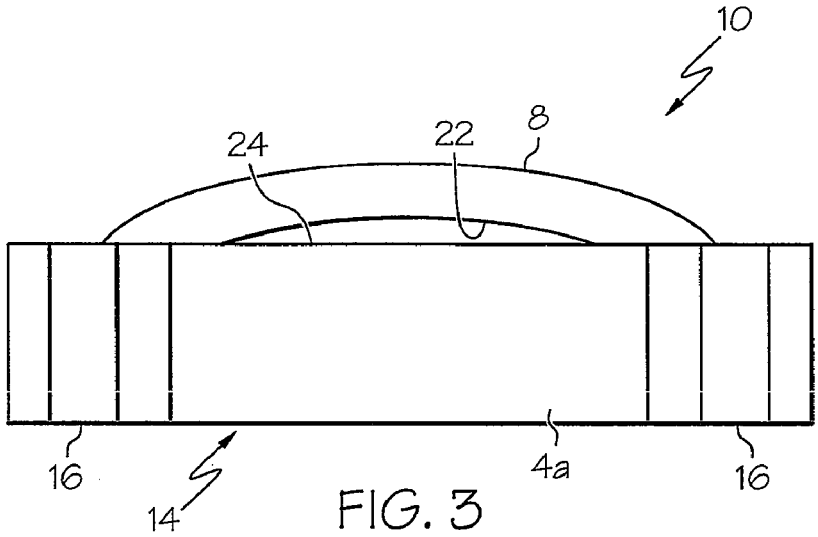
FIG. 3 illustrates a side view of a cushion apparatus in accordance with the present invention.
Figure 4:
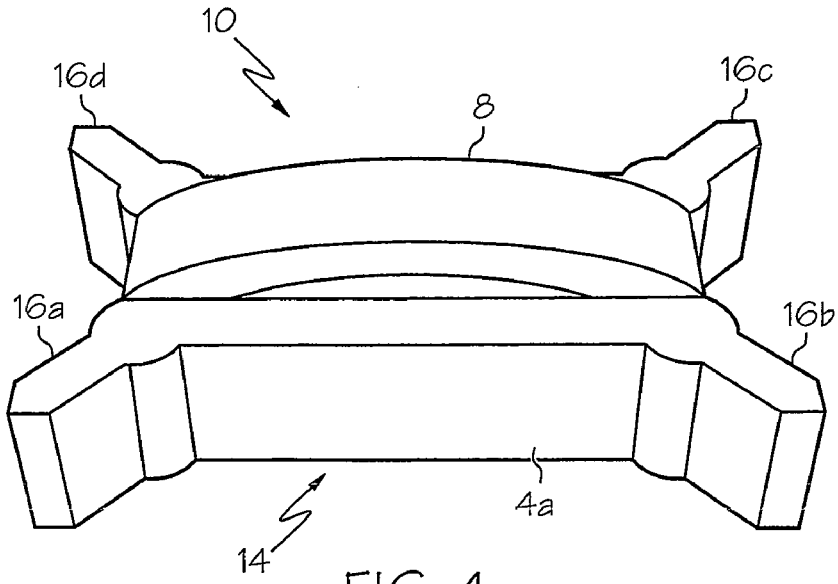
FIG. 4 depicts a perspective top view of a cushion apparatus in accordance with the present invention.

With reference now to the figures, wherein like reference numerals refer to like and corresponding parts throughout, there are illustrated various views of a cushion apparatus in accordance with the present invention. Referring specifically to FIGS. 1, 3, and 4, an end cap cushion apparatus 10 is depicted as an integrally molded unit generally comprising a base member 14, multiple radial deflection members 16*a*-16*d*, and an axial deflection member 8. Cushion apparatus 10 is preferably a unitary structure which may be molded from a suitable plastic material, using a thermoforming molding technique. As explained in further detail below, the relative configuration and dimensions of the constituent features of cushion apparatus 10, individually and in combination, provide improved dynamic cushioning performance to prior art end cap designs. The improved cushion performance, in terms of shock absorption and attenuation, enables utilization of smaller form factor end caps, thereby improving shipping package density.

As further shown in FIGS. 1, 3, and 4, the base member 14 of cushion apparatus 10 is substantially rectilinear in inner and outer contour, generally comprising a pair of lateral side walls 4*a* joined by a second pair of end side walls 4*b*. Together, lateral side walls 4*a* and end side walls 4*b* form a laterally enclosed product receiving cavity 6 having an open bottom end 18 for receiving an end or side portion of the product (not depicted) to be packaged. The enclosed portion of product receiving cavity 6 is defined by product bearing surfaces 2 of side walls 4*a* and 4*b*. The product bearing surfaces 2 of product receiving cavity 6 substantially conform to corresponding surfaces of the packaged product. At the other end of base member 14 and receiving cavity 6, in opposition to open end 18, is a top end over and across which axial deflection member 8 is disposed in an arc-like manner.

In the depicted embodiment, axial deflection member 8 comprises is an elastic member that preferably derives its elasticity from its arc contour as well as its constituent material. To this end, and in one embodiment, axial deflection member 8, base member 14, and radial deflection members 16*a*-16*d* are constructed of one or more materials included in the group comprising polyethylene and polypropylene, or other suitable material that results in compressive elasticity of the depicted curvilinear counter of axial deflection member 8.

In the preferred embodiment depicted in the figures, axial deflection member 8 is attached in a leaf spring like manner at each of two opposing sides of the top end of the product receiving cavity 6. Specifically, axial deflection member 8 has a substantially curvilinear lengthwise counter which, depending on the application, may be circular, elliptical, or parabolic. Axial deflection member 8 preferably has a substantially rectangular cross-section, and as illustrated in the perspective views of FIGS. 1 and 4 in conjunction with the side profile of FIG. 3, has a uniform lengthwise-arched contour residing in a plane substantially parallel to a plane coincident with one or more of side walls 4*a*. To achieve the desired level of shock absorption and damping, axial deflection member 8 preferably comprises an elastic material member formed as an arch spanning an opening 22 defined between the top of the base member side walls 4*a* and 4*b* and the bottom side of axial deflection member 8. In the depicted configuration, axial deflection member 8 advantageously spreads an applied shock load, such as from the packaged device being dropped, more broadly over the area of base member 14 across which axial deflection member 8 spans. In this manner, axial shock absorption performance is substantially enhanced by the elastic, resilient flexing of axial deflection member 8 rather than on cushioning material compressive material properties and bearing area, resulting in greater cushioning resiliency and durability of end cap cushioning apparatus 10. Furthermore, the enhanced dynamic shock absorption performance enables smaller end cap form factor, thus improving shipping density and overall packaging efficiency.

As further depicted in the exemplary embodiment, product receiving cavity 6 has a horizontal planar (relative to the depiction in FIG. 3) upper containment boundary 24 (FIG. 3) that substantially coincides with the top of the base member sidewalls 4*a* and 4*b*. In this manner, a product received within product receiving cavity 6 does not extend into the opening 22 spanned by axial deflection member 8 when the product is received within product receiving cavity 6.

Figure 2:
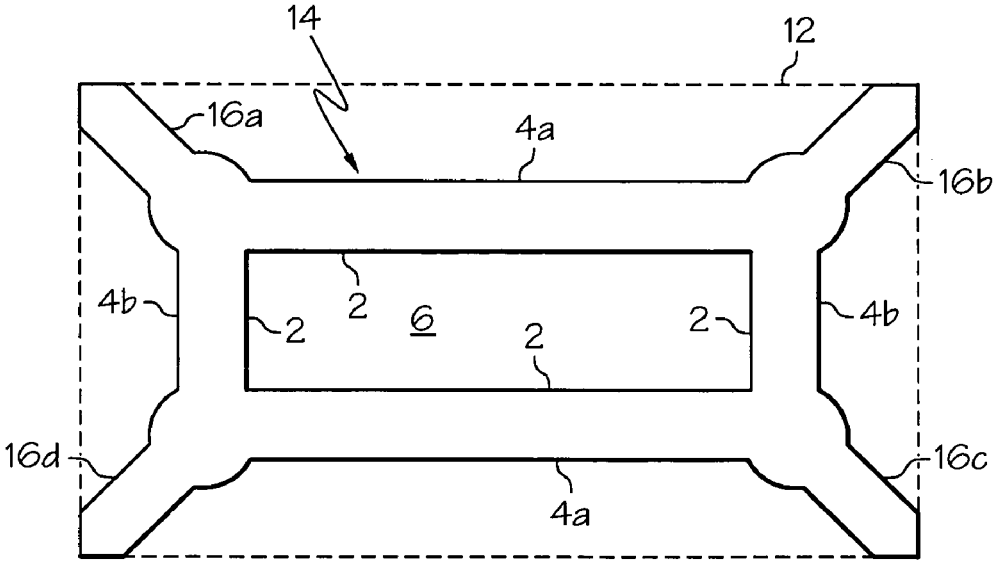
FIG. 2 depicts a bottom view of a cushion apparatus in accordance with the present invention.

As illustrated in particular with reference to FIG. 2, a preferred end cap cushion device 10 includes radial deflection members 16 that form a bearing support perimeter 12 in a manner that provides both inter-container product stability and enhanced shock absorption performance. Namely, and as shown in FIG. 2, radial deflection members 16*a*-16*d* define a substantially rectangular bearing support perimeter 12 with radial deflection members 16*a*-16*d* extending diagonally to the corners of the perimeter 12. The mutual disposition of radial deflection members 16*a*-16*d* is designed such that the bearing support perimeter substantially conforms to the inner rectangular contour of a packaging container (not depicted). Namely, the internal distances between adjacent pairs of corners of the packaging container are substantially equal to the distance between adjacent pairs of the contacting corners of radial deflection members 16*a*-16*d*.

As illustrated in FIG. 2, the relative configuration of radial deflection members 16*a*-16*d* with respect to base member 14 results in enhanced dynamic shock absorption for each side of base member 14 that relies in significant part on the dynamic flexing performance of deflection member pairs. Adjacent radial deflection members, such as adjacent pairs 16*a* and 16*b*, 16*b* and 16*c*, 16*c* and 16*d*, and 16*d* and 16*a* are adapted to flex away one from another under a shock load condition on the respective sidewall. In the depicted embodiment, the lateral side walls 4*a* are shock protected by adjacent deflection member pairs 16*a* and 16*b* and 16*d* and 16*c*, while end side walls 4*b* are shock protected by adjacent deflection member pairs 16*a* and 16*d* and 16*b* and 16*c*. In this manner, the shock absorption performance in the radial directions relies substantially on the elastic, resilient flexing of radial deflection members rather than on cushioning material compressive deflection properties and bearing area.

While the depicted embodiment is designed to accommodate a packaging container having a rectangular inner containment cross-section, the principle of design may be applied to containers having different cross-section shapes. More generally stated, the end cap cushion of the present invention comprises a plurality of radial deflection members that define a multi-sided bearing support perimeter having multiple corners, wherein the radial deflection members extend diagonally to the corners of the bearing support perimeter to provide the dual container bracing and shock absorption enhancing performance described above with reference to FIG. 2.

While the invention has been particularly shown and described with reference to a preferred embodiment, it will be understood by those skilled in the art that various changes in form and detail may be made therein without departing from the spirit and scope of the invention.

What is claimed is:

1. A cushion apparatus comprising:

a base member having a product receiving cavity, said product receiving cavity having an open bottom end for receiving a product and an opposing top end;

a plurality of radial deflection members extending radially from said base member; and an axial deflection member disposed over said top end;

wherein said axial deflection member comprises a compressively elastic material member; and wherein said axial deflection member is in the shape of a leaf spring, arches over said top end, and attaches to opposing sides of said top end only at opposing ends of the leaf spring shape.

2. The cushion apparatus of claim 1, wherein said base member is substantially rectangular.

3. The cushion apparatus of claim 1, wherein said base member, said radial deflection members, and said axial deflection member are molded as an integral unit.

4. The cushion apparatus of claim 1, wherein said base member, said radial deflection members, and said axial deflection member are constructed of one or more materials included in the group comprising polyethylene and polypropylene.

5. The cushion apparatus of claim 1, wherein said base member comprises one or more side walls having inner product bearing surfaces defining said product receiving cavity, wherein a cross-section of said axial deflection member is curved shaped in a plane substantially parallel to a plane coincident to at least one side wall, said axial deflection member spanning an opening defined between the top of the base member side walls and said axial deflection member.

6. The cushion apparatus of claim 5, wherein the inner product bearing surfaces of the product receiving cavity substantially conform to corresponding surfaces of the product when the product is received in the cavity.

7. The cushion apparatus of claim 5, wherein the product receiving cavity has an upper containment boundary substantially coinciding with the top of the base member sidewalls, such that a product received by the product receiving cavity does not extend into the opening spanned by said axial deflection member when said product is received within said product receiving cavity.

8. The cushion apparatus of claim 1, wherein said plurality of radial deflection members define a substantially rectangular bearing support perimeter.

9. The cushion apparatus of claim 8, wherein the radial deflection members extend diagonally to the corners of the rectangular bearing support perimeter.

* * * * *

UNITED STATES PATENT AND TRADEMARK OFFICE

CERTIFICATE OF CORRECTION

PATENT NO. : 7,648,750 B2
APPLICATION NO. : 11/297666
DATED : January 19, 2010
INVENTOR(S) : Sattora et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 637 days.

Signed and Sealed this

Twenty-third Day of November, 2010

David J. Kappos

David J. Kappos
*Director of the United States Patent and Trademark Office*